US010215148B2

(12) United States Patent
Jiang et al.

(10) Patent No.: US 10,215,148 B2
(45) Date of Patent: Feb. 26, 2019

(54) NO-START DIAGNOSTICS FOR POWERTRAIN WITH ENABLED STARTER

(71) Applicant: GM GLOBAL TECHNOLOGY OPERATIONS LLC, Detroit, MI (US)

(72) Inventors: Shengbing Jiang, Rochester Hills, MI (US); Xinyu Du, Oakland Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 15/250,251

(22) Filed: Aug. 29, 2016

(65) Prior Publication Data

US 2018/0058413 A1 Mar. 1, 2018

(51) Int. Cl.
*F02N 11/00* (2006.01)
*F02N 11/10* (2006.01)

(52) U.S. Cl.
CPC ..... *F02N 11/108* (2013.01); *F02N 2200/022* (2013.01); *F02N 2200/043* (2013.01); *F02N 2200/0802* (2013.01)

(58) Field of Classification Search
CPC ..... F02N 11/108; F02N 2200/022; F02N 2200/043; F02N 2200/0802; F02N 11/14; F02N 2200/062; F02N 2200/063; F02N 2200/044; F02N 2200/061
USPC ..... 701/113
See application file for complete search history.

(56) References Cited

U.S. PATENT DOCUMENTS 3,786,789 A * 1/1974 Barr ..... F02D 41/10 123/478
4,257,382 A * 3/1981 Matsui ..... F02D 41/005 123/438
4,732,246 A * 3/1988 Tateno ..... B60W 10/02 192/218
6,414,464 B2 7/2002 Peter
6,838,780 B2 * 1/2005 Shiga ..... H02K 9/06 290/38 R
9,108,633 B1 * 8/2015 Atluri ..... B60W 20/10
9,251,309 B2 2/2016 Shin et al.
(Continued)

FOREIGN PATENT DOCUMENTS

DE 19958098 A1 6/2001
DE 102010000679 A1 7/2011
(Continued)

*Primary Examiner* — David E Hamaoui
*Assistant Examiner* — Susan E Scharpf
(74) *Attorney, Agent, or Firm* — Quinn IP Law

(57) ABSTRACT

A method diagnoses a no-start condition in a powertrain having an engine and a starter system operable for starting the engine. The starter system includes a battery, solenoid relay, starter solenoid, and starter motor. The method includes recording starter data over a calibrated sampling duration in response to a requested start event when the solenoid relay is enabled, including a cranking voltage and engine speed. If no battery current sensor is used, the method derives a resistance ratio using an open-circuit voltage and a minimum cranking voltage of the battery. When such a sensor is used, the method derives a battery and starter resistance. A fault mode of the starter system is then identified via a controller using the starter data and either the resistance ratio or the battery and starter resistances. A control action executes that corresponds to the identified fault mode.

19 Claims, 2 Drawing Sheets

(56) References Cited

U.S. PATENT DOCUMENTS 9,272,625 B2 * 3/2016 Sonesson ..... B60L 1/00
9,284,896 B2 * 3/2016 Atluru ..... F02D 35/0007
2004/0207204 A1 * 10/2004 Shiga ..... H02K 9/06 290/38 R
2010/0180849 A1 * 7/2010 Senda ..... F02N 11/0855 123/179.4
2011/0175357 A1 * 7/2011 Navetta ..... F02D 29/06 290/47
2012/0010802 A1 * 1/2012 Ma ..... F02D 41/062 701/113
2013/0162030 A1 * 6/2013 Sonesson ..... B60L 1/00 307/10.1
2013/0296126 A1 * 11/2013 Gibson ..... F02N 11/006 477/5
2013/0297191 A1 * 11/2013 Gibson ..... F02N 11/0855 701/112
2013/0317729 A1 * 11/2013 Mitsuyama ..... F02D 35/00 701/113
2015/0175103 A1 * 6/2015 Yamazaki ..... B60R 16/02 701/29.1
2015/0210271 A1 * 7/2015 Yamazaki ..... F02N 11/04 701/22
2015/0211469 A1 * 7/2015 Ghoneim ..... F02N 11/0825 701/113
2015/0361941 A1 * 12/2015 Du ..... F02N 11/108 702/33
2016/0017857 A1 * 1/2016 Ghoneim ..... F02N 11/108 701/34.4

FOREIGN PATENT DOCUMENTS

DE 102010040520 A1 3/2012
DE 102012215984 A1 3/2013
JP 2001317398 A 11/2001
JP 2013108426 A 6/2013
WO 2013191619 A1 12/2013

* cited by examiner

40

| FC | $V_C$ | $RPM_E$ | R | $R_S$ | $R_B$ | $I_C$ | $T_E$ |
|---|---|---|---|---|---|---|---|
| I | H | O | N/A | N/A | N/A | L | O |
| II | V | L | H | N | H | V | L |
| III | | | H | L | N | H | L |
| IV | | | L | L | N | V | L |
| V | | | N | N | N | V | L |
| VI | | | N | N | N | H | H |
| VII | V | H | N | N | N | H | H |

NO-START DIAGNOSTICS FOR POWERTRAIN WITH ENABLED STARTER

TECHNICAL FIELD

The present disclosure relates to a no-start fault diagnostic method and system for use in a powertrain having a controller-enabled starter system.

BACKGROUND

Conventional powertrains typically include an internal combustion engine that uses reciprocating pistons disposed within corresponding engine cylinders to combust a mixture of fuel and air. The combustion process generates engine torque on a driveshaft, which in turn is delivered to a transmission via a hydrodynamic torque converter or a friction clutch. An output member of the transmission ultimately acts on a load. The load may be in the form of a set of drive wheels when the powertrain is used to power an automotive vehicle, or in the form of a propeller shaft, generator, conveyor, or another load in other powertrain configurations.

In order for the engine to start, an engine flywheel must be rotated from a standstill to above a threshold speed, with the threshold speed being sufficient for initiating an intake of the fuel/air mixture into the cylinders via a fuel delivery system. An operator may request an engine start event by depressing a start button or turning an ignition key, or such a request may be generated autonomously or remotely. The received request closes a solenoid control relay, which in turn causes an electrical current to be delivered to a starter solenoid.

The starter motor has a shaft on which is disposed a translatable pinion gear. The pinion gear is ultimately urged by a lever arm by operation of the starter solenoid into engagement with a mating gear element disposed on the engine flywheel. The starter motor gear is then energized so that torque from the starter motor rotates the engine via the engaged pinion gear and engine flywheel to the threshold speed noted above. Upon release of the ignition key or starter button, the solenoid control relay opens to disconnect the battery from the starter motor and starter solenoid. The starter motor stops and the pinion gear disengages from the flywheel. The internal combustion process is thereafter sustained via operation of the fuel delivery system.

A successful engine starting event thus occurs when a controller, e.g., an engine control module, enables the starter control relay via an electronic enable signal and, after passage of a calibrated duration, the engine starts. However, a "no-start" condition sometimes results even when the starter control relay has been properly enabled. While a faulty starter control relay may be the culprit for such a failure mode, other fault candidates exist, including a faulty battery, starter solenoid, starter motor, or power/grounding wire for the starter motor or solenoid. Other fault candidates include a faulty pinion gear or flywheel, engine, or fuel delivery system. However, conventional diagnostic approaches are typically unable to distinguish one fault mode from the other, which can complicate maintenance and repair efforts.

SUMMARY

Disclosed herein are methods and related systems for performing no-start diagnostics in a powertrain having a controller-enabled starter control relay. As disclosed herein, the present approach utilizes a starting sequence to accurately isolate a no-start fault mode with an enabled starter control relay, and to execute different control actions based on the isolated fault mode.

In a particular embodiment, a method is disclosed for diagnosing a no-start condition in a powertrain having an engine fueled by a fuel delivery system and a starter system operable for starting the engine. The starter system includes a battery, a solenoid relay, a starter solenoid, and a starter motor, and is characterized in this embodiment by an absence of a current sensor configured to measure a maximum cranking current of the battery.

The method includes recording a set of starter data over a calibrated sampling duration in response to a requested start event when the solenoid relay is in an enabled state, including a cranking voltage and a speed of the engine, and deriving a resistance ratio using an open-circuit voltage and a minimum cranking voltage of the battery.

The method also includes identifying one of a plurality of different fault modes of the starter system via a controller using the set of starter data and the resistance ratio, and then executing a control action corresponding to the identified fault mode. Executing a control action may include recording a diagnostic fault code corresponding to the identified fault mode.

In another embodiment in which the intelligent battery sensor is used to measure a maximum cranking current, instead of deriving a resistance ratio as described above, the controller instead derives a battery resistance and a starter resistance using the open-circuit voltage, minimum cranking voltage, and a measured maximum cranking current of the battery.

A powertrain is also disclosed herein that, in an embodiment, includes an engine, a clutch, a transmission having an input member connectable to the engine via the clutch, a load connected to an output member of the transmission, a starter system operable for starting the engine, and a controller. The starter system has a battery and a solenoid relay, a starter solenoid, and a starter motor having a pinion gear. The pinion gear is selectively engaged with the flywheel via operation of the starter solenoid to start the engine. The controller is in communication with the starter system, and is configured to execute the method or methods noted above.

The above features and advantages and other features and advantages of the present disclosure are readily apparent from the following detailed description of the best modes for carrying out the disclosure when taken in connection with the accompanying drawings.

DETAILED DESCRIPTION

Figures 1, 2:
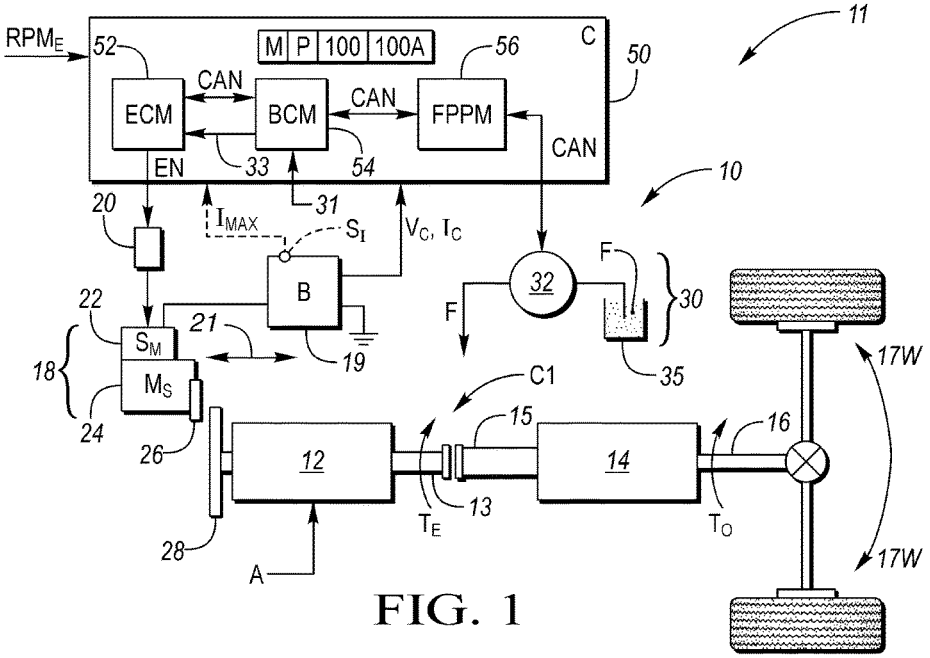
FIG. 1 is a schematic illustration of an example powertrain having a starter motor, a starter control relay, and one or more controllers programmed to diagnose a no-start fault condition that occurs in the presence of an enabled starter control relay.
FIG. 2 is a table describing possible fault modes and corresponding control parameters for the example powertrain of FIG. 1.

Referring to the drawings, wherein like reference numbers refer to the same or like components in the several Figures, a powertrain 10 is depicted schematically in FIG. 1. The powertrain 10 includes an internal combustion engine 12, and may also include a transmission 14. As is known in the art, the engine 12 is operable for combusting a mixture of air (arrow A) and fuel (arrow F) drawn from a sump 35 to generate engine torque (arrow $T_E$). The engine torque (arrow $T_E$) is then delivered to the transmission 14 via a driveshaft 13 via a clutch C1, e.g., a friction clutch or a hydrodynamic torque converter.

The transmission 12 has an input member 15 and an output member 16. The input member 15 is connectable to the engine 12 via the clutch C1, while a load, e.g., the drive wheels 17W, a drive axle, or another load, is connected to the output member 16. In the example embodiment of FIG. 1, the powertrain 10 is used aboard a vehicle 11 having a set of drive wheels 17W, with the drive wheels 17W forming or contributing to the load (both the "drive wheels" and the "load" being hereinafter designated by reference numeral 17W) in the non-limiting vehicular embodiment of FIG. 1. Other embodiments, both vehicular and non-vehicular, may be envisioned, and thus the load 17W may be variously configured as, e.g., a generator, propeller or propeller shaft, conveyor, or other load. The example embodiment of the vehicle 11 will be described hereinafter for illustrative consistency.

The powertrain 10 includes a starter system 18 operable for starting the engine 12. The starter system 18 includes a battery (B) 19, a starter control relay 20, a starter solenoid ($S_M$) 22, and a starter motor ($M_S$) 24. The starter motor 24 includes a pinion gear 26 that is selectively engaged with a flywheel 28 of the engine 12 via operation of the starter solenoid 22 to start the engine 12 as noted above. The powertrain 10 also includes a controller (C) 50 in the form of a group of controllers configured, i.e., programmed in software and equipped in hardware, to diagnose no-start faults of the powertrain 10 when the starter system 18 is enabled by a designated one of the controllers 50. For illustrative simplicity, the group of controllers 50 is shown and described herein in the singular. However, in practice the controller 50 may include multiple control devices each performing designated control functions as described herein.

Each noted control module described below includes a processor (P) and memory (M), which similarly are shown as one device without limiting embodiments to such a configuration. The memory (M) includes tangible, non-transitory memory, e.g., read only memory, whether optical, magnetic, flash, or otherwise. The controller 50 also includes sufficient amounts of random access memory, electrically-erasable programmable read only memory, and the like, as well as a high-speed clock, analog-to-digital and digital-to-analog circuitry, and input/output circuitry and devices, as well as appropriate signal conditioning and buffer circuitry.

In a possible embodiment, the controller 50 may include multiple control modules each having dedicated functions. For instance, in the embodiment of FIG. 1 in which the powertrain 10 is used as part of the vehicle 11, the controller 50 may include an engine control module (ECM) 52, a body control module (BCM) 54, and a fuel pump power module (FPPM) 56, all of which are known in the art, and all of which are in communication with each other via a controller area network (CAN) bus. The BCM 54 transmits a crank request signal (arrow 33) to the ECM 52 in response to receipt by the BCM 54 of an engine start request signal (arrow 31).

The controller 50 may include additional control modules or processors necessary for monitoring the starting process, recording the needed data, and performing the disclosed diagnosis. Such a control module could be a diagnostic tool connected to the CAN bus, or a combination of an onboard module and an off-board back-office server where the onboard module monitors the starting process and collects the needed data and sends the data to the back-office server and the back-office server performs the diagnosis based on the data received. In other words, the methods of the present disclosure are not limited by the ways in which such methods are implemented.

If the CAN bus and associated communications protocols and supporting hardware function properly, the ECM 52 will receive the crank request signal (arrow 33) and, in response, enable the starter control relay 20 via an electronic enabling signal (arrow EN). Thereafter, the battery 19 powers the starter motor 24, the pinion gear 26 of the starter motor 24 is translated into engagement with the flywheel 28 or a geared element connected thereto, as indicated by double-headed arrow 21, and the engine 12 is rotated to above a threshold speed. Above the threshold speed, a fuel delivery system 30 supplies fuel (arrow F) to the engine 12 via a fuel pump 32 and other components, such as a fuel rail and injectors (not shown). Thereafter, the pinion gear 26 disengages from the flywheel 28 and the starter motor 24 turns off.

In a successful start of the engine 12, the engine 12 should smoothly crank and start within a few seconds of receipt by the ECM 52 of the crank request signal (arrow 33). However, when the start event is unsuccessful, a "no-start" condition is presented. The controller 50 is therefore configured to diagnose and handle such faults as set forth herein with reference to FIGS. 2-4.

Figure 3:
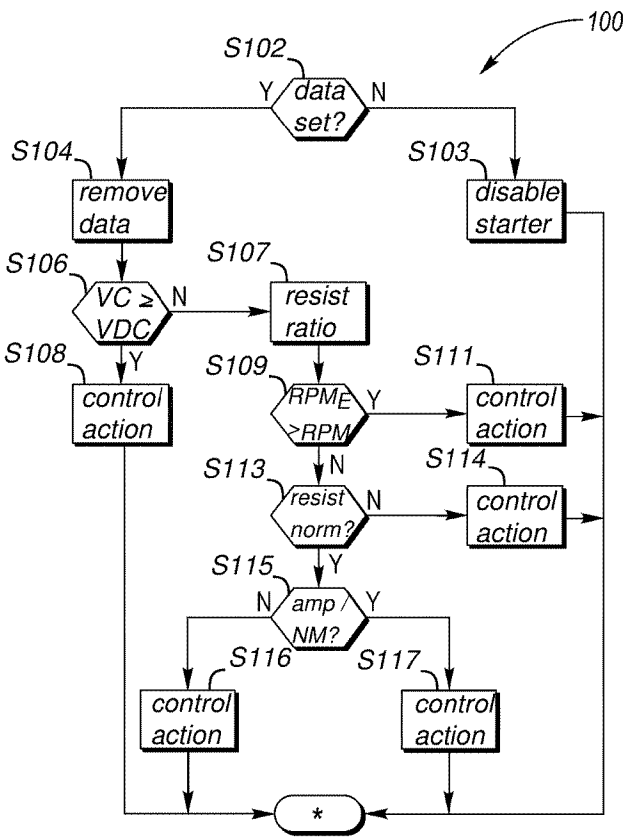
FIG. 3 is an example method for diagnosing a no-start condition in the powertrain of FIG. 1 when the starter control relay is enabled, and when the starter system is characterized by an absence of an intelligent battery sensor.

In particular, the controller 50 is programmed to diagnose no-start/starter-enabled faults in a manner that depends on whether the powertrain 10 uses an optional intelligent battery sensor ($S_I$). As is known in the art, an intelligent battery sensor ($S_I$) measures a maximum cranking current ($I_{MAX}$) from the battery 19, as well as determines a maximum voltage. When no sensor ($S_I$) is used, the controller 50 may execute a method 100, e.g., as shown in FIG. 3. A modified version of the method 100, depicted in FIG. 4 as method 100A, is executed in the alternative when the optional intelligent battery sensor ($S_I$) is used as part of the powertrain 10 or starter system 18.

The controller 50 in both of the methods 100 and 100A records a set of starter data over a calibrated sampling duration, doing so in response to a requested start event when the solenoid control relay 20 is in the enabled state. The controller 50 determines or receives a cranking voltage ($V_C$) and a speed ($RPM_E$) of the engine 12, e.g., as reported values from the ECM 52 or as directly measured. The controller 50 then derives a resistance value, with the identity of the derived resistance value depending on whether or not the powertrain 10 includes the intelligent battery sensor ($S_I$).

With respect to the resistance value in particular, if the starter system 18 is characterized by an absence of the intelligent battery sensor ($S_I$), the controller 50 derives a resistance ratio (R) as a function of an open-circuit voltage ($V_{OC}$) and a minimum cranking voltage ($V_{MIN}$) of the battery 19 as set forth below with reference to FIG. 3. If the starter system 18 includes the sensor ($S_I$), the controller 50 instead derives a battery resistance ($R_B$) and a starter resistance ($R_S$) using the open-circuit voltage ($V_{OC}$), the minimum cranking voltage ($V_{MIN}$), and a maximum cranking current ($I_{MAX}$) of the battery 19 as measured by the intelligent battery sensor ($S_I$), with this alternative embodiment described with reference to FIG. 4. In both embodiments, the controller 50 identifies one of a plurality of different fault modes of the starter system 18 using the collected set of starter data and the derived resistance values, and executes a corresponding control action corresponding to the identified fault mode.

FIG. 2 depicts a table 40 of possible starter data that may be used by the controller 50 to diagnose no-start faults of the starter system 18 using the method 100 or 100A. The possible faults may be divided into a plurality of fault classes. Class I collectively includes faults pertaining generally to the starter control relay 20 or associated wires, the starter solenoid 22, an open-coil state of the starter motor 24, or starter power/ground wire open circuit faults. Class II includes low state of charge/high resistance faults of the battery 19. Class III includes a coil short of the starter motor 24. Class IV includes a high-resistance state of the starter motor 24. Class V includes a fault of the pinion gear 26, clutch C1, or flywheel 28, or a weak magnetic field of the starter motor 24. Class VI includes seized engine 12 or high friction on the engine 12. Class VII includes a fault in the fuel delivery system 30. The controller 50 is programmed to isolate a detected fault into one of these different fault classes, whereupon further diagnostics and repair by a trained technician may be accomplished.

In the example table 40, a set of parameters for associated starter data includes cranking voltage ($V_C$), engine speed ($RPM_E$), a battery/starter resistance ratio (R), starter resistance ($R_S$), battery resistance ($R_B$), cranking current ($I_C$), and engine torque ($T_E$). As noted above, some of these values are not used depending on whether or not the starter system 18 includes the intelligent battery sensor ($S_I$). The controller 50 examines the set of starter data collected or reported to the ECM 52 or other control modules, and determines which of the fault classes I-VI is present.

For instance Fault Class I is present when the cranking voltage ($V_C$) is at a constant high level (H), engine speed ($N_E$) is zero, and cranking current ($I_C$) is at a constant low level (L) with zero engine torque ($T_E$). Any of the fault classes may be present, with the different fault classes determined based on the high (H)/normal (N)/low (L)/or variant (V) levels of the associated parameters of FIG. 2. For Fault Class IV, the high/low (H/L) values of Fault Class IV are shown in the respective battery/starter resistance ratio ($R_B$) or starter resistance ($R_S$) columns depending on whether the intelligent battery sensor ($I_C$) is used, as will now be explained with reference to FIGS. 3 and 4.

Referring to FIG. 3, an example embodiment of method 100 is shown that is used when the powertrain 10 or starter system 18 is characterized by an absence of the intelligent battery sensor ($S_I$) noted above. While specific parameters of the powertrain 10 are described below, the controller 50 responds to an operator-generated or autonomously generated requested start event by enabling the starter control relay 20, and then recording cranking voltage ($V_C$), cranking current ($I_C$), engine torque ($T_E$), and engine speed ($RPM_E$). If after a calibrated cranking duration the controller 50 does not see an active run state of the engine 12, the controller 50 determines if the starter control relay 20 has been enabled for at least a calibrated duration, e.g., 5 s. If so, the controller 50 further reads battery state of charge (SOC), minimal cranking voltage ($V_{MIN}$), maximum cranking current ($I_{MAX}$), and reports a no-start fault and call collected start data. Then, using the method 100 or 100A described below, the controller 50 further isolates the no-start fault.

Method 100 begins with step S102, wherein the controller 50 receives and records a set of starter data over a calibrated sampling duration in response to a requested start event when the solenoid control relay 20 is in an enabled state, i.e., when the ECM 52 has transmitted the enable signal (arrow EN) to the starter control relay 20. The starter data includes the cranking voltage ($V_C$)/cranking current ($I_C$) and engine speed ($N_E$) shown in FIGS. 1 and 2. At step S102, the controller 50 records the starter data over a sampling duration, e.g., 5 seconds, then proceeds to step S104. If the controller 50 is unable to record the starter data for the calibrated sampling duration, e.g., due to a communications error on the CAN bus, the method 100 proceeds to step S103.

Step S103 includes recording a diagnostic code corresponding to a data collection/transfer fault. The ECM 52 disables the starter system 18, and the method 100 is complete.

Step S104 includes the optional step of removing the earliest- and latest-collected data from step S102, e.g., the first and last second or two of data in an example embodiment. Such a step may help avoid transient noise or other effects during measurement of the starter data. The method 100 then proceeds to step S106.

At step S106, the controller 50 determines whether all measured cranking voltages (VC) over the duration of the collected starter data equal or exceed a voltage threshold, e.g., 11 VDC, and that all engine speeds ($RPM_E$) are zero. Step S107 is executed if either condition is not present, and to step S108 when both conditions are satisfied.

At step S107, the controller 50 derives a resistance ratio (R) using an open-circuit voltage ($V_{OC}$) and a minimum cranking voltage ($V_{MIN}$) of the battery 19. As is known in the art, open-circuit voltage ($V_{OC}$) is determined from a mapping table based on battery state of charge and battery temperature. Thus, memory (M) of the controller 50 may be programmed with such a table. As is known in the art, both battery state of charge and battery temperature are measured/estimated and reported to the controller 50 as part of the ongoing operation of the powertrain 10. The minimum cranking voltage ($V_{MIN}$) is likewise a value known to the controller 50, e.g., via the BCM 54, as an internally stored value. The method 100 then proceeds to step S109.

Step S108 includes executing a control action corresponding to a lack of power to the starter motor 24, a faulty wire conducting the enable signal (EN), a faulty solenoid 22, or a faulty power/ground conductor to the starter motor 24, or an open-circuit fault of coils of the starter motor 24. Upon diagnosis, the further distinguishing between these possible faults may thereafter be achieved in a more efficient manner by a service technician. The method 100 is then finished (*).

Step S109 includes determining whether all engine speeds ($RPM_E$) in the collected starter data exceed a speed threshold, e.g., 160 RPM. The method 100 proceeds to step S111 when all engine speeds ($RPM_E$) in the collected starter data exceed a speed threshold, and to step S113 when the engine speeds ($RPM_E$) do not exceed such a speed threshold.

Step S111 includes executing a control action corresponding to a second identified fault mode, which in this instance corresponds to a faulty engine 12 or fuel delivery system 30. The method 100 is then finished (*).

Step S113 includes determining if the prior-calculated resistance ratio (R) is within a predefined or normal/expected range, with such a range being a calibrated value that could vary based on the powertrain 10. The method 100 proceeds to step S114 if the resistance ratio (R) is not within the normal/expected range, and to step S115 if the resistance ratio (R) is within the normal/expected range.

At step S114, the controller 50 executes a control action corresponding to a third identified fault mode, which in this instance corresponds to low state of charge/high resistance level of the battery 19, or a short in the starter motor 24, or a high resistance level in the starter motor 24. In step S114, the controller 50 may use the value of the resistance ratio (R) to further distinguish which of these fault modes are present, e.g., by assigning different possible ranges of the resistance ratio (R) to the various fault modes. The method is then finished (*).

At step S115, the controller 50 determines if an average cranking current over the duration of step S102 exceeds a calibrated current threshold, or in the alternative, whether a torque level of the starter motor 24 of FIG. 1 exceeds a calibrated torque threshold. The method 100 proceeds to step S116 when the applied current or torque condition of step S115 is not satisfied, and to step S117 when the condition is satisfied.

Step S116 includes executing a control action corresponding to a fourth identified fault mode, which in this instance corresponds to a faulty pinion gear 26, clutch C1, flywheel 28, or a weak magnetic field of the starter motor 24. Distinguishing between these possible faults may then be achieved in a more efficient manner by a service technician. The method 100 is then finished (*).

Step S117 includes executing a control action corresponding to a fifth identified fault mode, which in this instance corresponds to a seized engine 12 or a high-friction condition in the engine 12. Again, distinguishing between these two possible faults may be achieved by a service technician. The method 100 is then finished (*).

Figure 4:
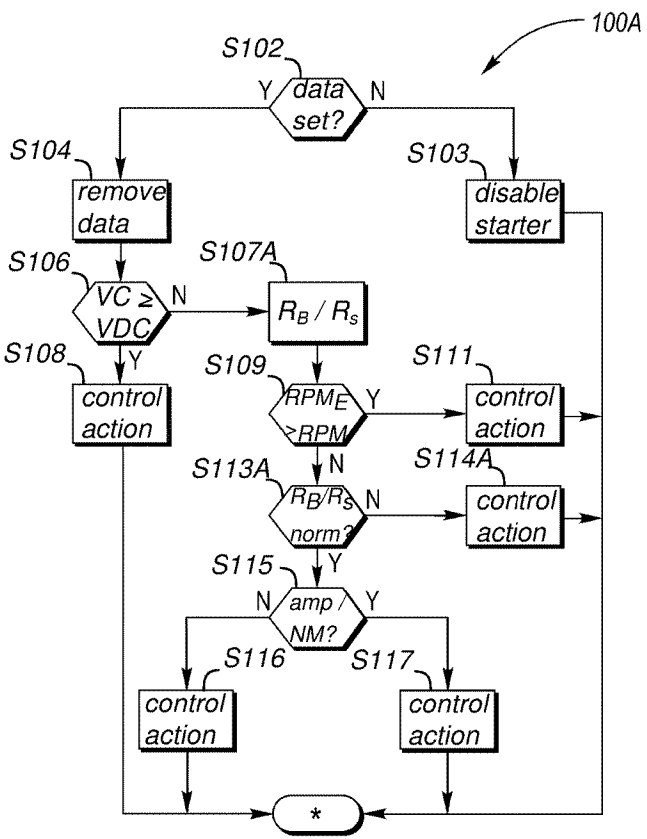
FIG. 4 is an example method for diagnosing a no-start condition in the powertrain of FIG. 1 when the starter control relay is enabled, and when the starter system includes an intelligent battery sensor.

FIG. 4 depicts an alternative embodiment 100A of the method 100 in which the powertrain 10 or starter system 18 includes the intelligent battery sensor (IS). In the method 100A, all of the steps of method 100 are unchanged with the exception of steps S107, S113, and S114. These steps are labeled S107A, S113A, and S114A in FIG. 4. All other previously-described steps are described above in the discussion of FIG. 3 and, for simplicity, their respective descriptions are not repeated with reference to FIG. 4.

With respect to alternative step S107A, the controller 50 derives a battery resistance ratio ($R_B$) and a starter resistance ($R_S$) using a maximum current ($I_{MAX}$), an open-circuit voltage ($V_{OC}$) a minimum cranking voltage ($V_{MIN}$) of the battery 19. Both the open-circuit voltage ($V_{OC}$) is and the minimum cranking voltage ($V_{MIN}$) are described above with reference to FIG. 3. The maximum cranking current ($I_{MAX}$) is measured and provided via the intelligent battery sensor ($I_S$).

To perform step S107A, the controller 50 may solve the equations:

$$(R_B) = \frac{V_{OC} - V_{MIN}}{I_{MAX}}; \text{ and}$$

$$(Rs) = \frac{V_{MIN}}{I_{MAX}};$$

The method 100A then proceeds to step S109 as described above.

Alternative step S113A includes determining if the battery and starter resistances $R_B$ and $R_S$, respectively, are both within a respective predefined or normal/expected range, with such a range being a calibrated value that could vary based on the configuration of the powertrain 10. The method 100A proceeds to step S114A if the resistances $R_B$ and $R_S$ are not within the normal/expected range, and to step S115 if the resistances $R_B$ and $R_S$ are within the normal/expected range.

At step S114A of method 100A, the controller 50 executes a control action corresponding to a third identified fault mode, which in this instance corresponds to low state of charge/high resistance level of the battery 19, or a short in the starter motor 26, or a high resistance level in the starter motor 26. In step S114A, the controller 50 may use the value of the respective battery and starter resistances $R_B$ and $R_S$ to further distinguish which of these particular fault modes are present, e.g., by assigning different possible ranges of the respective battery and starter resistances $R_B$ and $R_S$, either alone or together, to the various fault modes. The method 100A is then finished (*).

Using the method 100 or 100A integrated into the powertrain 10 described above, a no-start condition with an enabled starter control relay 20 may be diagnosed in the powertrain 10 without the need for additional sensing hardware. Starter data is recorded over a calibrated sampling duration in response to a requested start event when the solenoid relay is in an enabled state. The resistance ratio (R) is derived (FIG. 3) or the battery and starter resistances $R_B$ and $R_S$ (FIG. 4) are derived, with the controller 50 identifying one of a plurality of different fault modes of the starter system 18 using the set of starter data and the particular resistance values. The controller 50 can then execute a control action corresponding to the identified fault mode.

While the best modes for carrying out the disclosure have been described in detail, those familiar with the art to which this disclosure relates will recognize various alternative designs and embodiments for practicing the disclosure within the scope of the appended claims.

The invention claimed is:

1. A method for diagnosing a no-start condition in a powertrain of a vehicle with a fuel delivery system and an electronic controller, the powertrain having an engine fueled by the fuel delivery system and a starter system operable for starting the engine, wherein the starter system includes a battery, a solenoid relay, a starter solenoid, and a starter motor, the powertrain being characterized by an absence of a current sensor configured to measure a maximum cranking current ($I_{MAX}$), the method comprising:

transmitting, via the electronic controller of the vehicle in response to receiving an engine start request, an enable signal to the solenoid relay to thereby activate the starter solenoid and engage the starter motor with the engine;

recording, via the electronic controller of the vehicle, a set of starter data over a calibrated sampling duration in response to a no-start event when the solenoid relay is in an enabled state, the set of starter data including a cranking voltage and a speed of the engine;

deriving, via the electronic controller, a resistance ratio (R) using an open-circuit voltage ($V_{OC}$) of the battery and a minimum cranking voltage ($V_{MIN}$) of the battery, wherein $$R = \left(\frac{V_{OC}}{V_{MIN}}\right) - 1;$$

identifying one of a plurality of different fault modes of the starter system via the electronic controller using the set of starter data and the resistance ratio (R); and executing a control action corresponding to the identified fault mode, wherein the control action includes disabling the starter system.

2. The method of claim 1, wherein the control action further includes recording a diagnostic fault code corresponding to the identified fault mode.

3. The method of claim 2, wherein recording the diagnostic fault code includes recording a first diagnostic fault code corresponding to a faulty starter system when the cranking voltage exceeds a voltage threshold and the engine speed is zero over a first duration.

4. The method of claim 2, wherein recording the diagnostic fault code includes recording a second diagnostic fault code corresponding to a faulty engine or fuel delivery system when the engine speed is above a speed threshold over a second duration.

5. The method of claim 2, wherein recording the diagnostic fault code includes recording a third diagnostic fault code corresponding to a fault of the battery or the starter motor when the resistance ratio (R) is outside of a predetermined range over a second duration.

6. The method of claim 5, wherein the powertrain includes a transmission connectable to the engine via a clutch, and the engine includes a flywheel, and wherein recording the diagnostic fault code includes recording a fourth diagnostic fault code corresponding to a faulty pinion gear of the starter motor, a faulty clutch, a faulty flywheel, or a faulty magnetic field of the starter motor when the resistance ratio (R) is within the predetermined range over the second duration and an average cranking current over the second duration is less than a calibrated current threshold.

7. The method of claim 6, wherein recording the diagnostic fault code includes recording a fifth diagnostic code corresponding to a faulty engine when the resistance ratio (R) is within the predetermined range and the average cranking current over the second duration equals or exceeds the calibrated current threshold.

8. A method for diagnosing a no-start condition in a powertrain of a vehicle with an electronic controller, the powertrain having an engine and a starter system operable for starting the engine, wherein the starter system includes a battery, a current sensor configured to measure a maximum cranking current ($I_{MAX}$) of the battery, a solenoid relay, a starter solenoid, and a starter motor, the method comprising:

transmitting, via the electronic controller of the vehicle in response to receiving an engine start request, an enable signal to the solenoid relay to thereby activate the starter solenoid and engage the starter motor with the engine;

recording, via the electronic controller of the vehicle, a set of starter data for a first duration in response to a no-start event when the solenoid relay is in an enabled state, the set of starter data including a cranking voltage and a speed of the engine;

deriving, via the electronic controller, a battery resistance ($R_B$) and a starter resistance ($R_S$) using an open-circuit voltage ($V_{OC}$), a minimum cranking voltage ($V_{MIN}$), and the maximum cranking current ($I_{MAX}$) of the battery, wherein $$(R_B) = \frac{V_{OC} - V_{MIN}}{I_{MAX}},$$

and $$(Rs) = \frac{V_{MIN}}{I_{MAX}};$$

identifying one of a plurality of different fault modes of the starter system via a controller using the set of starter data, the battery resistance ($R_B$), and the starter resistance ($R_S$); and executing a control action corresponding to the identified fault mode, wherein the control action includes disabling the starter system.

9. The method of claim 8, wherein the control action further includes recording a diagnostic fault code corresponding to the identified fault mode.

10. The method of claim 9, wherein recording the diagnostic fault code includes recording a first diagnostic fault code corresponding to a faulty starter system when the cranking voltage exceeds a voltage threshold and the engine speed is zero over the first duration.

11. The method of claim 9, wherein recording the diagnostic fault code includes recording a second diagnostic fault code corresponding to a faulty engine or fuel delivery system when the engine speed is above a speed threshold over the first duration.

12. The method of claim 11, wherein recording the diagnostic fault code includes recording a third diagnostic fault code corresponding to a faulty battery or starter motor when the battery resistance ($R_B$) and the starter resistance ($R_S$) are outside of a predetermined range over the first duration.

13. The method of claim 12, wherein recording the diagnostic fault code includes recording a fourth diagnostic fault code corresponding to a faulty pinion gear, clutch, flywheel, or magnetic field of the starter motor when the battery resistance ($R_B$) and the starter resistance ($R_S$) are within the predetermined range over the first duration and an average cranking current over the first duration is less than a calibrated current threshold.

14. The method of claim 13, wherein recording the diagnostic fault code includes recording a fifth diagnostic code corresponding to a faulty engine when the battery resistance ($R_B$) and the starter resistance ($R_S$) are within the predetermined range over the first duration and the average cranking current over the first duration equals or exceeds the calibrated current threshold.

15. A powertrain comprising:

an engine operable for combusting a mixture of air and fuel, the engine including a flywheel;

a clutch;

a transmission having an input member and an output member, wherein the input member is connectable to the engine via the clutch;

a load connected to the output member of the transmission;

a starter system operable for starting the engine, the starter system having a battery, a solenoid relay, a starter solenoid, and a starter motor having a pinion gear that is selectively engaged with the flywheel via operation of the starter solenoid to start the engine; and a controller in communication with the starter system, and programmed to:

transmit, in response to receiving an engine start request, an enable signal to the solenoid relay to thereby activate the starter solenoid and engage the starter motor with the engine;

record a set of starter data over a calibrated sampling duration in response to a no-start event when the solenoid relay is in an enabled state, wherein the set of starter data includes a cranking voltage and a speed of the engine;

derive a resistance ratio (R) using an open-circuit voltage ($V_{OC}$) of the battery and a minimum cranking voltage ($V_{MIN}$) of the battery, wherein $$R = \left(\frac{V_{OC}}{V_{MIN}}\right) - 1;$$

identify one of a plurality of different fault modes of the starter system via a controller using the set of starter data and the resistance ratio (R); and execute a control action corresponding to the identified fault mode, including recording a diagnostic fault code corresponding to the identified fault mode, and disabling the starter system.

16. The powertrain of claim 15, wherein the control action includes recording, over multiple starting events, at least one of: a first diagnostic fault code corresponding to a faulty starter system when the cranking voltage exceeds a voltage threshold and the engine speed is zero over a first duration, a second diagnostic fault code corresponding to a faulty engine or fuel delivery system when the engine speed is above a speed threshold over a second duration, and a third diagnostic fault code corresponding to a battery or starter motor fault when the resistance ratio (R) is outside of a predetermined range over the second duration.

17. The powertrain of claim 16, wherein the control action further includes recording, over multiple starting events, at least one of a fourth diagnostic fault code corresponding to a faulty pinion gear of the starter motor, a faulty clutch, a faulty flywheel, or a fault magnetic field of the starter motor when the resistance ratio (R) is within the predetermined range over the second duration and an average cranking current over the second duration is less than a calibrated current threshold.

18. The powertrain of claim 17, wherein recording a diagnostic fault code further includes recording, over the multiple starting events, a fifth diagnostic code corresponding to a faulty engine when the resistance ratio (R) is within the predetermined range and the average cranking current over the second duration equals or exceeds the calibrated current threshold.

19. The powertrain of claim 17, wherein the powertrain is a vehicle powertrain and the load includes a plurality of drive wheels of the vehicle.

* * * * *